US006439386B1

(12) United States Patent
Sauer et al.

(10) Patent No.: US 6,439,386 B1
(45) Date of Patent: Aug. 27, 2002

(54) PACKAGED ABSORBENT PAPER PRODUCT, CONTAINER, AND DISPENSING METHOD

(75) Inventors: Barbara O. Sauer; Mary Rece Holt, both of Fremont, WI (US); Richard Frederick House, Geneva, IL (US); Paul Roy Schmidt; Herb F. Velazquez, both of Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/727,807

(22) Filed: Nov. 30, 2000

(51) Int. Cl.[7] ..... B65D 73/00; B65H 1/00

(52) U.S. Cl. ..... 206/494; 206/806; 221/45; 221/61; 221/102

(58) Field of Search ..... 206/233, 409, 206/410, 494, 806, 812; 221/45, 46, 61, 64, 102; 383/8, 9

(56) References Cited

U.S. PATENT DOCUMENTS

| | | | | | |
|---|---|---|---|---|---|
| 2,122,048 | A | * | 6/1938 | Shapiro | 206/494 |
| 2,279,658 | A | * | 4/1942 | Crebbs | 206/494 |
| 3,089,586 | A | * | 5/1963 | Cole | 206/494 |
| 3,095,087 | A | * | 6/1963 | Yates | 221/45 |
| 3,738,721 | A | | 6/1973 | Maschek et al. | |
| 3,744,448 | A | | 7/1973 | Boone | |
| 3,794,253 | A | | 2/1974 | Megdall | |
| 3,824,953 | A | | 7/1974 | Boone | |
| 3,830,198 | A | | 8/1974 | Boone | |
| 3,834,636 | A | | 9/1974 | Linick | |
| 3,837,595 | A | | 9/1974 | Boone | |
| 4,004,687 | A | | 1/1977 | Boone | |
| 4,017,002 | A | | 4/1977 | Doyle et al. | |
| D247,077 | S | | 1/1978 | Gruber | |
| 4,101,026 | A | | 7/1978 | Bonk | |
| 4,106,617 | A | | 8/1978 | Boone | |
| 4,205,802 | A | | 6/1980 | Economakis | |
| 4,235,333 | A | | 11/1980 | Boone | |
| 4,274,573 | A | * | 6/1981 | Finkelstein | 206/409 |
| D262,422 | S | | 12/1981 | Ortiz et al. | |
| 4,385,733 | A | | 5/1983 | O'Keefe | |
| 4,453,649 | A | * | 6/1984 | Origuchi | 221/45 |
| 4,513,923 | A | | 4/1985 | Ulics | |
| 4,607,809 | A | | 8/1986 | Sineni et al. | |
| D289,140 | S | | 4/1987 | Fischer et al. | |
| 4,662,577 | A | | 5/1987 | Lewis | |
| 4,690,345 | A | | 9/1987 | Cotey | |
| D293,182 | S | | 12/1987 | Carter | |
| 4,739,809 | A | * | 4/1988 | Adams | 206/233 |
| 4,765,475 | A | | 8/1988 | Kaysserian | |
| 4,834,316 | A | | 5/1989 | DeLorean | |
| 4,913,312 | A | | 4/1990 | Boutin | |
| 4,978,095 | A | | 12/1990 | Phillips | |
| 5,054,675 | A | | 10/1991 | Taves | |
| 5,076,424 | A | | 12/1991 | Nakamura | |

(List continued on next page.)

FOREIGN PATENT DOCUMENTS

| | | |
|---|---|---|
| WO | WO 86/05076 A1 | 9/1986 |
| WO | WO 96/33647 A1 | 10/1996 |

*Primary Examiner*—Bryon P. Gehman
(74) *Attorney, Agent, or Firm*—Scott A. Baum

(57) ABSTRACT

A product comprising an absorbent paper material and a container for use as a dispenser, which is adapted to hanging from a support member, such as a towel bar, is disclosed. The container can be optionally located on a surface, such as a counter top, and used as a dispenser. This provides the container with two different dispensing modes. The container has a hanger member integral with the container on one end, and the hanger member is attachable to the container in at least two separate positions. The hanger member is also adapted to covering at least a portion of the absorbent paper material exposed by an opening into the container prior to hanging the container.

27 Claims, 6 Drawing Sheets

U.S. PATENT DOCUMENTS 5,076,465 A * 12/1991 Lawson ..... 221/63
5,228,632 A 7/1993 Addison et al.
5,375,928 A 12/1994 Yarng et al.
5,398,824 A 3/1995 Wolff et al.
5,447,227 A * 9/1995 Koseberg ..... 206/233
5,605,250 A 2/1997 Meiron et al.
5,623,880 A 4/1997 Kuntz
5,799,895 A 9/1998 Michaud et al.
5,897,074 A 4/1999 Marino
5,904,316 A 5/1999 Dunning et al.
5,951,762 A 9/1999 Shangold et al.
D419,016 S 1/2000 Twitty
6,112,936 A * 9/2000 Arizmendi ..... 221/45

* cited by examiner

PACKAGED ABSORBENT PAPER PRODUCT, CONTAINER, AND DISPENSING METHOD

BACKGROUND

The present invention relates to a product comprising an absorbent paper material in a container, and the container for the absorbent paper material. In households today there is an ever-increasing demand for novel ways to dispense absorbent paper materials such as facial tissue, bathroom tissue, paper towels, napkins, and the like. In particular, with the increase in the number of items stored on counters and shelves and the resulting decrease in available counter space, there is a need to provide dispensing methods or products of absorbent paper materials, which reduce or eliminate the amount of counter space required. Thus, dispensers or products that have a reduced footprint while still dispensing standard size absorbent paper materials, or hanging dispensers or products, which eliminate the need for any counter space usage, are consumer preferred.

In addition, absorbent paper materials are frequently used in areas with exposure to liquids and moisture such as kitchens and bathrooms. Conventional cartons of absorbent paper materials, when placed on counters, can be damaged by associated liquid spills. By providing a dispenser that hangs or a dispenser that protects the absorbent paper material from moisture, the product's usefulness to consumers is enhanced.

For the foregoing reasons, there is a need for a packaged absorbent paper product that reduces the need to place the dispenser on a counter, or that protects the absorbent paper material inside the dispenser from liquids.

SUMMARY

The present invention is directed to a product comprising an absorbent paper material in a container that satisfies one or more of these needs, and a method of dispensing the absorbent paper material. The invention provides a significant advantage in that the absorbent paper material is protected from moisture damage by liquids on surfaces and counters by hanging from a support member. Another advantage is that the product eliminates counter space requirements by hanging while still providing acceptable dispensing performance. An additional advantage is that the container can be used as a dispenser when hanging or when the container is placed on a counter, thus providing two separate dispensing modes.

Hence in one aspect, the invention resides in a combination of a container and an absorbent paper material comprising: a substantially enclosed container having an interior volume, an interior surface, and a first opening; an absorbent paper material in the container; and a hanger member having a first hanger end integral with the container, and a second hanger end releasably attached to the container.

In another aspect, the invention resides in a method of dispensing an absorbent paper material comprising: releasing a second hanger end of a hanger member attached to a container by a first attachment member; wrapping the second hanger end of the hanger member around a support member; reattaching the second end of the hanger member to the container with a second attachment member; and withdrawing the absorbent paper material through an opening in the container.

DESCRIPTION THE DRAWINGS

These and other features, aspects, and advantages of the present invention will become better understood with regard to the following description, appended claims, and accompanying drawings where:

DETAILED DESCRIPTION

Figure 1:
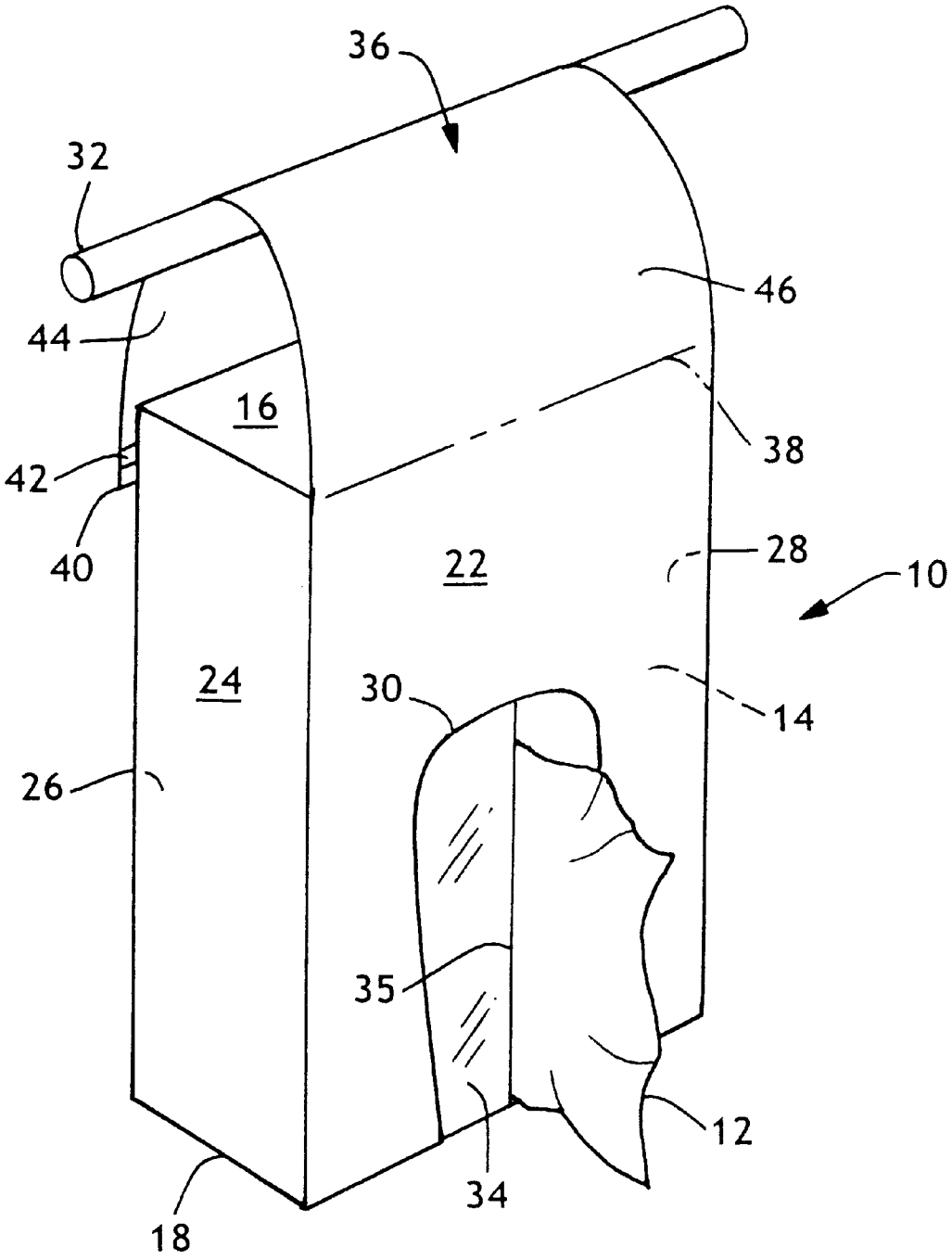
FIG. 1 is an isometric view of an embodiment of the invention.

Referring to FIG. 1, a product comprising a container 10 and an absorbent paper material 12 is shown. The container 10, as herein described, is designed to provide the advantage of two dispensing modes. The container 10 may be any size or shape useful for containing the absorbent paper material 12. In a specific embodiment, the container 10 is disposable upon depletion of the absorbent paper material 12, and constructed from board, carton stock, heavy paper, and the like. The absorbent paper material 12 is substantially in contact with an interior surface 14 of the container 10, and not housed within a second container or carton. However, it is possible to design the container 10 to be refillable, and constructed from a sturdier substrate such as plastic, metal, or the like. A refillable container, or a dispenser, could be used with an absorbent paper material purchased in another pre-packaged container, such as a facial tissue carton, that is placed into the dispenser. It is also possible to refill the container 10 with absorbent paper materials 12 purchased in bulk, and not housed in individual containers.

Figure 1A:
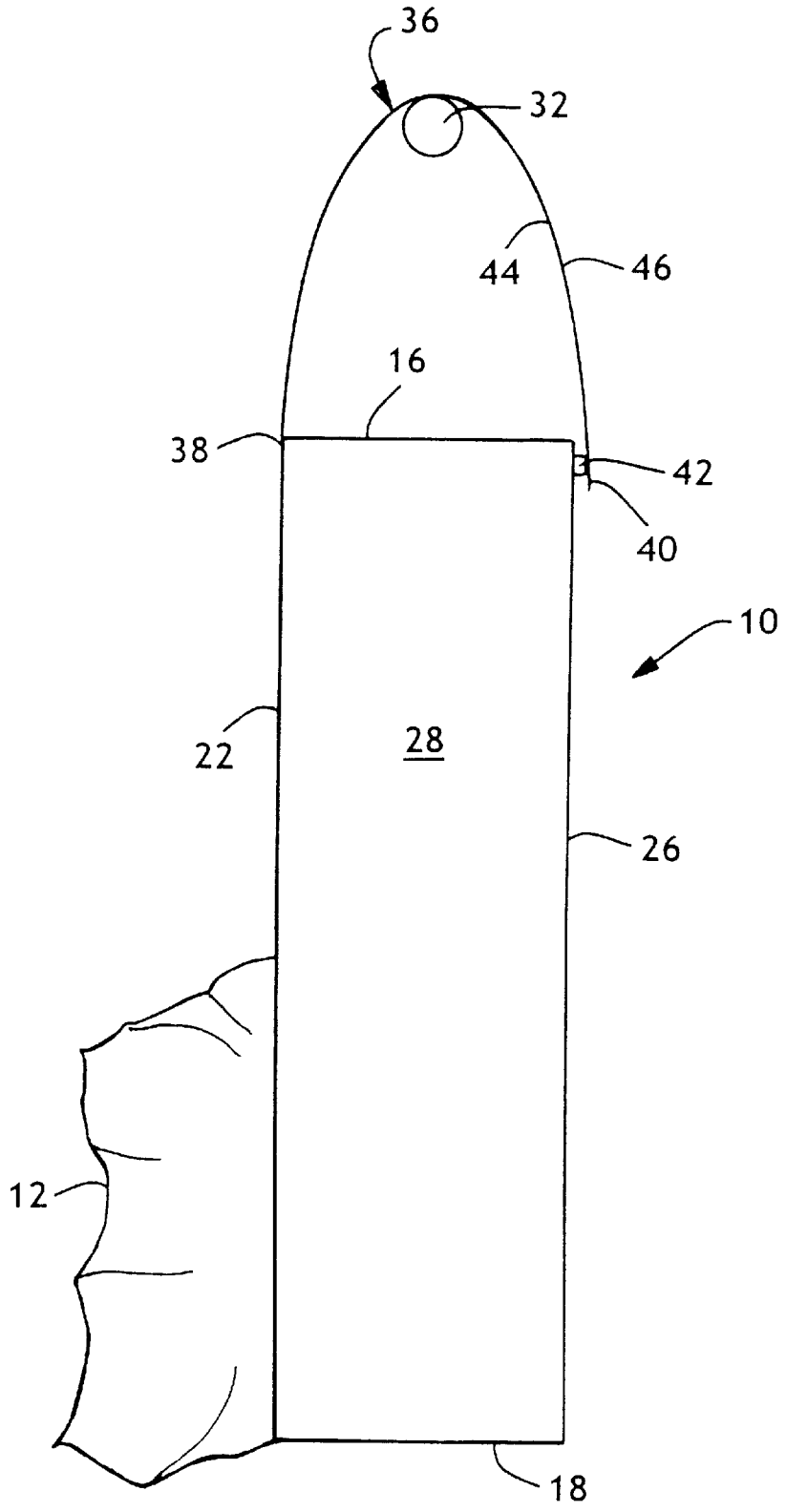
FIG. 1A is an elevation view of FIG. 1.

In a specific embodiment, the container 10 has a first end 16, a second end 18, and a sidewall comprised of four panels 22, 24, 26, and 28 as shown in FIG. 1 and FIG. 1A. The container 10 is generally rectangular. Generally rectangular means that at least one side of the container 10 is rectangular, although not all sides of the container 10 necessarily meet at right angles. Thus, a three dimensional parallelogram is generally rectangular. However, it is possible to construct the container 10 in a spherical shape, a cylindrical shape, or any other three-dimensional volume by use of a differently shaped sidewall and/or end panel. For instance, a cylindrical container would have one sidewall and two circular ends, while a spherical container would only have one continuous sidewall.

A first opening 30 is provided into the interior of the container 10. In a specific embodiment, the first opening 30 is located partially panel 22 of the container's sidewall and partially in the second end 18. Construction of the first opening 30 partially in the sidewall and partially in the second end 18 has the advantage of convenient dispensing independent of the container's orientation. Thus, acceptable dispensing performance is achieved when the container 10 is placed on a surface, or when the container 10 is hung from a support member 32. However, any size, style, or location of opening configured to dispense an absorbent paper material 12 through the sidewall from the interior of the container 10 is possible. The type of absorbent paper material 12 being dispensed will dictate the style of opening. Alternative first openings may be located entirely in the container's ends or in any of the container's panels forming the sidewall.

All or a portion of the absorbent paper material 12 exposed by the first opening 30 may be covered by at least one cover 34 as is conventionally practiced with facial tissue cartons. For instance, a removable cover created by lines of perforation in the container 10 may occupy all or a portion of the first opening 30 (not shown). The removable cover is stripped from the container 10 prior to dispensing the absorbent paper material 12. Alternatively, the absorbent paper material 12 may be covered by a poly film wrap that is removed (not shown). In a preferred embodiment, a poly film window with a slit 35 is present as the cover 34 covering the absorbent paper material 12, and a removable cover (not shown) is supplied to protect the absorbent paper material prior to dispensing. However, if desired a poly film window in combination with the poly film wrap could be utilized instead. Alternatively, as later herein described, the hanger member 36 can be initially attached to the container 10 to cover the first opening 30.

As shown in elevation in FIG. 1A, the container 10 has a hanger member 36 that has a first hanger end 38 integral with the container 10, and a second hanger end 40. Integral means the first hanger end 38 is a continuous portion of the container 10. The second hanger end 40 is not integral as shown in FIG. 1A, but is attached to the container 10 by a first attachment member 42. It is also possible to construct the hanger member 36 such that both the first hanger end 38 and the second hanger end 40 are integral to the container 10. The hanger member 36 also has a first opposing surface 44 and a second opposing surface 46.

Figure 2A:
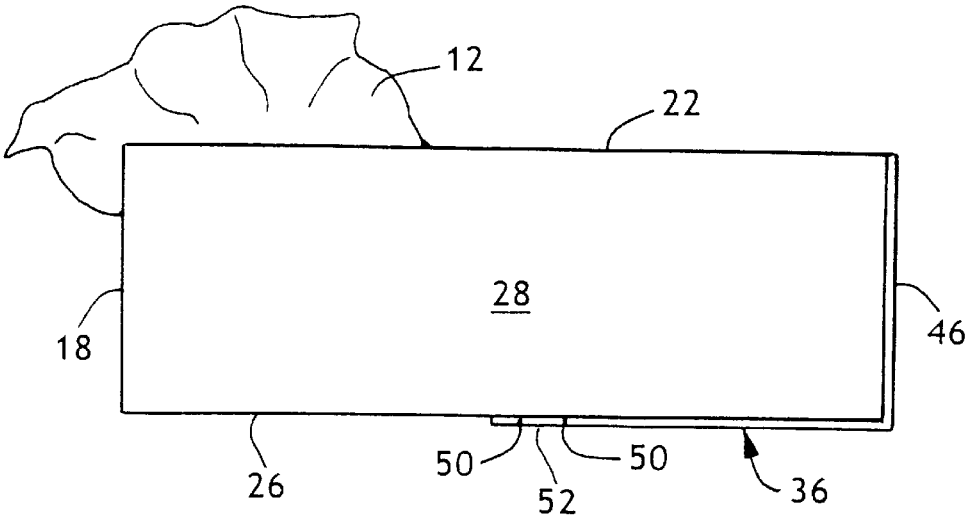
FIG. 2A is an elevation view of FIG. 2.
Figure 2:
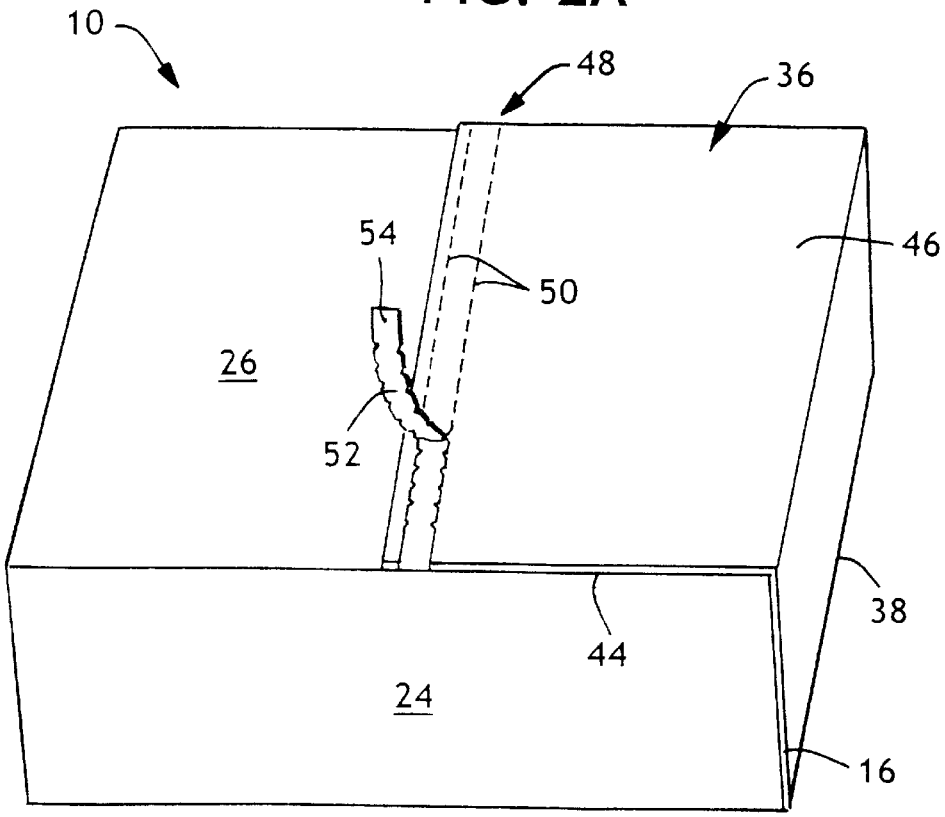
FIG. 2 is an isometric view of an embodiment prior to hanging the container.

Referring now to FIG. 2, the hanger member 36 is illustrated in a position when the product is purchased by a consumer. The hanger member 36 is attached to the container 10 such that the first opposing surface 44 is substantially in contact with the container 10. If desired, the container 10 can be used in a non-hanging mode by leaving the hanger member 36 attached to the container 10 as shown in FIG. 2A. With the first opposing surface 44 substantially adjacent the container 10, no loop is present to hang the dispenser from the support member 32. The hanger member 36 is attached to the container 10, as received by the consumer, by a second attachment member 48 prior to hanging the container. Alternatively, the first attachment member 42 can be used to secure the hanging member 36 in its two alternate positions.

If desired, the container 10 may be hung from the support member 32 by releasing the second hanger end 40 from the container 10, wrapping the hanger member 36 around the support member 32, and then reattaching the second hanger end 40 to the container 10. In the hanging mode, at least a portion of the first opposing surface 44 is adjacent the container 10, while another portion of the first opposing surface 44 is adjacent the support member 32. This creates a loop between the first end 16 and the first opposing surface 44, which allows the container 10 to hang from the support member 32.

In a specific embodiment, the first attachment member 42 is an adhesive, and the second attachment member 48 is a plurality of perforated lines 50 defining a strip 52. To hang the container, a consumer grasps a tab 54 and removes the strip 52 attaching the second hanger end 40 to the container 10. The first attachment member 42 is made inoperative in this position by placing an appropriate release means between the first attachment member 42 and the container 10. Such a release means may be a release strip placed over the adhesive secured to the first opposing surface 44, or a release strip on panel 26 preventing the adhesive from attaching the second hanger end 40 to the container. After removing the strip 52, the consumer wraps the hanger member 36 around the support member 32, and then reattaches the hanger member 36 to the container 10 with the adhesive.

Another possibility, instead of including a release means, is a latex co-adhesive or rubber cement for the first attachment member 42. Latex co-adhesive is applied to the first opposing surface 44 of hanger member 36 near the second hanger end 40. Offset relative to the first application of the adhesive, additional latex co-adhesive is applied to the panel 26 near the first end 16 of the container 10. Because the two adhesive locations are offset, the hanger member 36 can be removed from the panel 26. The two adhesive strips act as the first and second attachment members. After wrapping the hanger member 36 around the support member 32, the two adhesive locations are aligned and pressed together. This reactivates the adhesive providing a secure bond for the second hanger end 40 to the container 10.

As previously mentioned, two separate or different types of attachment members are not required. For instance, an adhesive first attachment member 42 could be used in both of the hanger member's positions instead of the plurality of perforated lines 50 and the strip 52 combined with an adhesive. Alternate types of attachment members may be utilized. For instance examples of alternative attachment members, by way of illustration and without limitation, include adhesives, hook and loop materials, tabs and slots, lines of perforation with or without a strip, clips, glue, hooks, and tape.

The container 10 preferably contains an interfolded stack of paper towels as the absorbent paper material, although other products may be packaged in the container. A product comprising container 10 and a stack of interfolded paper towels has the advantage of two dispensing modes—resting on a surface or hanging from a support member. While being utilized in the hanging mode, the container has the advantage of eliminating any counter surface requirements, and protecting absorbent paper material 12 from damage due to liquids that may be present on the surface.

Figure 3:
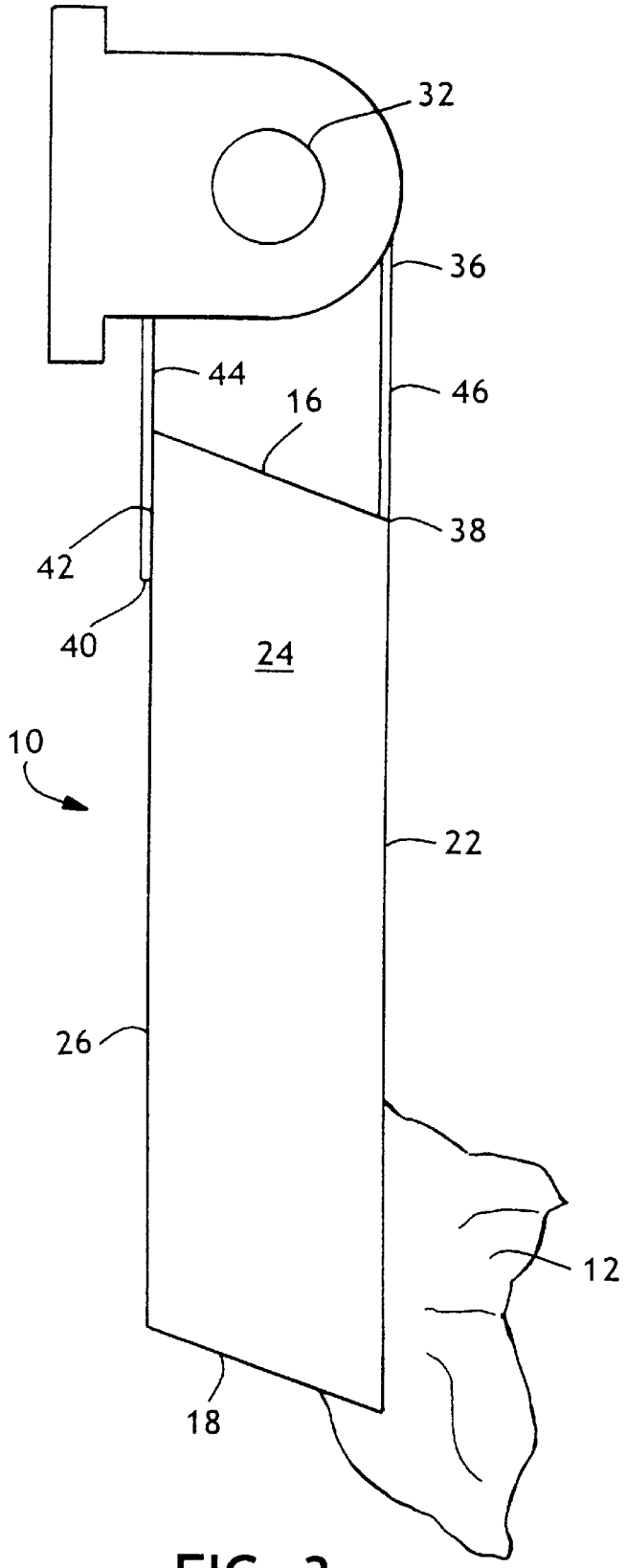
FIG. 3 is an isometric view of an alternative embodiment of the invention.

FIG. 3 shows an alternative embodiment of the invention in an elevation view hanging from a towel bar. In this embodiment the container 10 has been altered to have a parallelogram profile as shown. The three dimensional parallelogram shown is generally rectangular since panels 16, 18, 22, and 26 are rectangular. The parallelogram profile has the advantage of feeding the absorbent paper material 12 towards the first opening 30 as the material is depleted. The helps eliminate the need to reach into the container when there is a missed interfold or dispensing problem. Because the remaining interfolded absorbent paper materials are near the first opening 30, it is easy to restart the dispensing process. In addition, the trapezoidal profile is aesthetically pleasing. The interfolded absorbent paper material 12 is shown after dispensing several sheets of the material.

Figure 4:
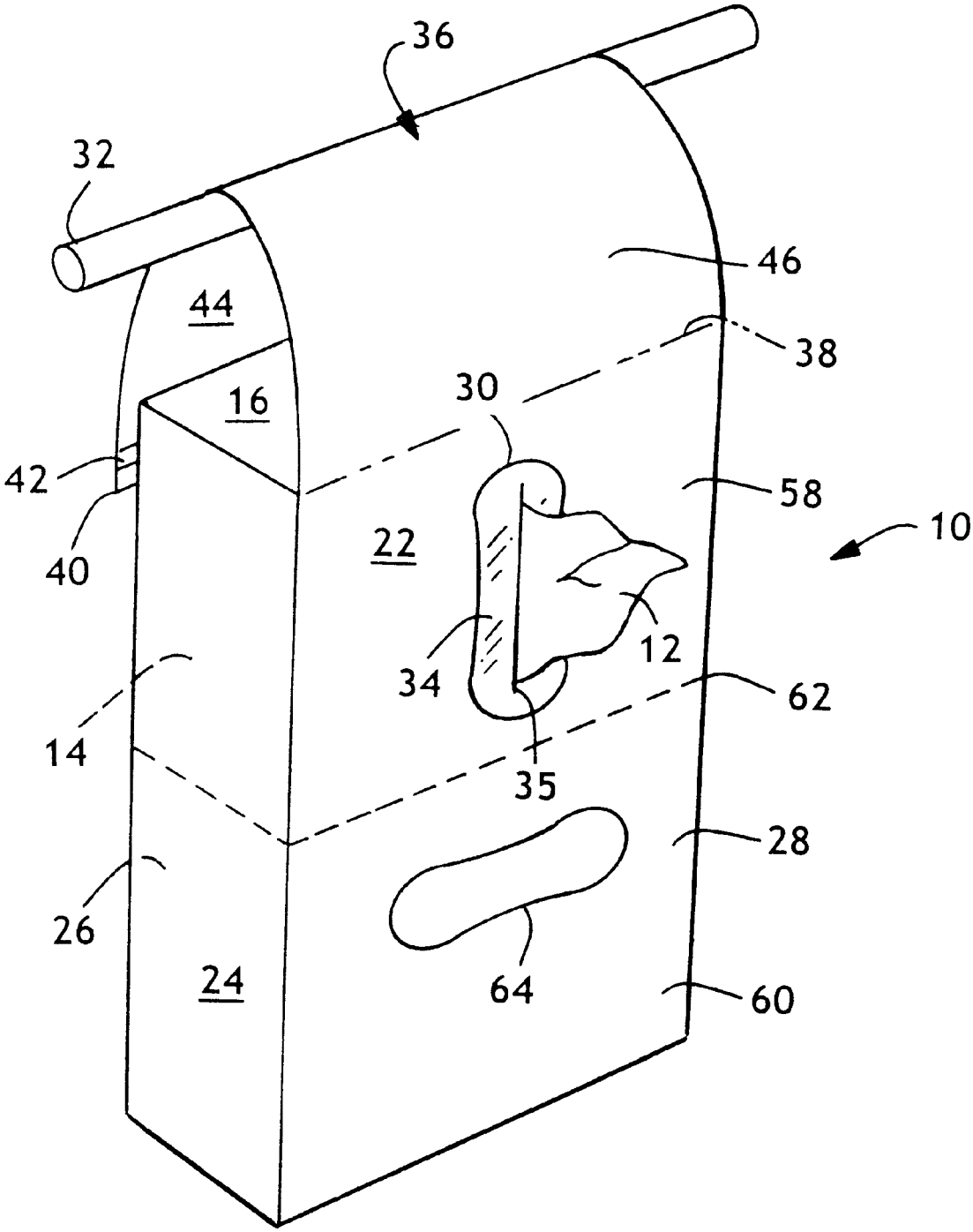
FIG. 4 is another alternative embodiment of the invention.

Referring now to FIG. 4, an alternative embodiment of the invention is shown. The container 10 has a first compartment 58, and a second compartment 60 separated by an internal partition 62 attached to an interior surface 14 of the container 10. An absorbent paper material 12 is located in the first compartment 58. The container 10 may be any shape or size useful for containing an absorbent paper material, and need not be the generally rectangular shape shown.

A first opening 30 into the interior of the first compartment 58 is provided, and adapted to dispense the absorbent paper material 12. The first opening 30 may be any shape or size useful for dispensing the absorbent paper material 12, and may be located anywhere in the first compartment 58. If desired, at least a portion of the absorbent paper material 12 may be covered by a cover 34 having a slit 35 as previously discussed.

A second opening 64 into the interior of the second compartment 60 is provided. The second compartment 60 is adapted to serving as a waste receptacle for soiled absorbent paper materials. The second opening 64 may be any convenient shape or size, and may be located anywhere in the second compartment 60. As previously discussed, the hanger member 36 is integral with container 10 on at least one end, and can be affixed to the container 10 in at least two distinct positions. The hanger member 36 is adapted to being removed from the container 10, wrapped around a support member 32, and then reattached to container 10 by an attachment member 42 or attachment members.

Figure 5:
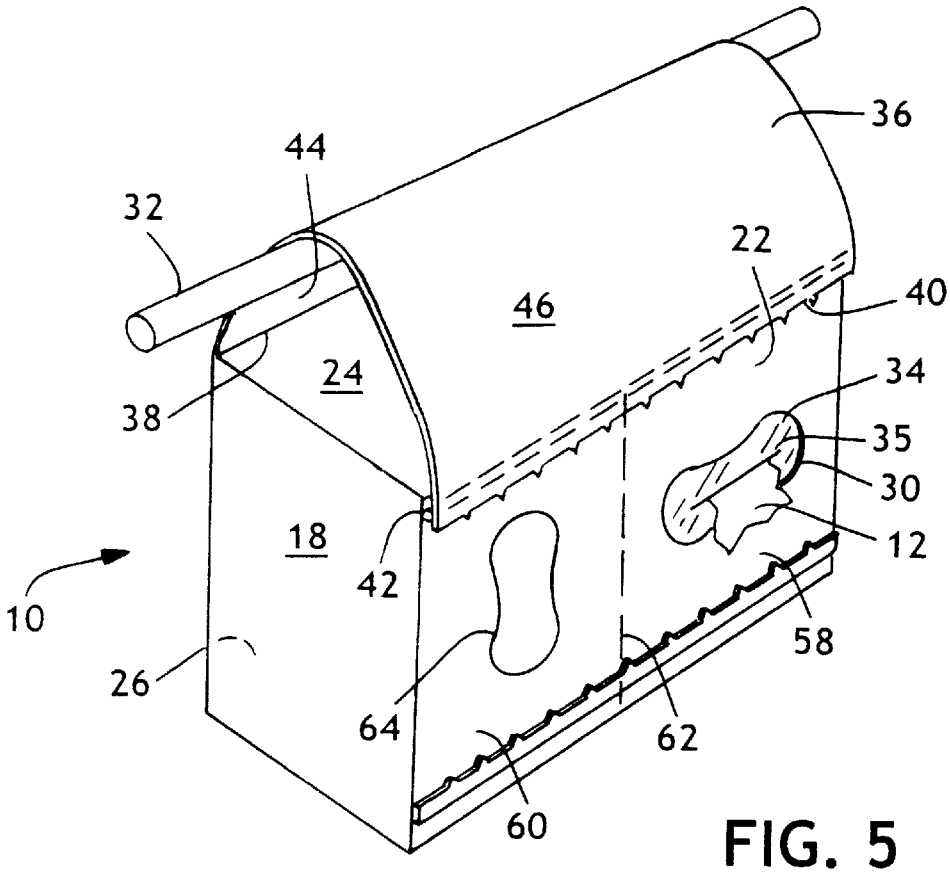
FIG. 5 is an isometric view of an alternative embodiment of the invention.
Figure 6:
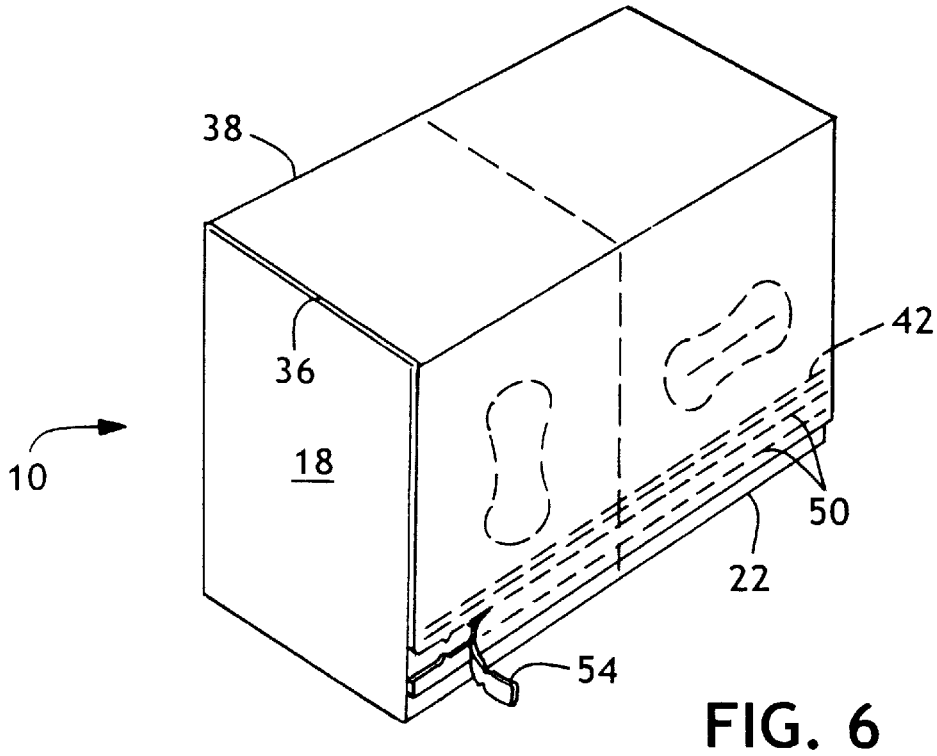
FIG. 6 is an isometric view of the embodiment of FIG. 5 prior to hanging the container.

FIG. 4 shows the first compartment 58 nearer the support member 32. It is possible to construct the container 10 such that the second compartment 60 is nearer the support member 32. It is also possible to construct the container 10 such that first hanger end 38 of the hanger member 36 is located on a different side of the container 10, such as the corner or edge connecting panels 24 and 26. This would change the orientation of the container 10 when hung from the support member 32 as shown in FIG. 5. In addition, locating the integral first hanger end 38 of hanger member 36 on such an edge would change the direction the consumer would need to wrap the hanger member 36 around the support member 32. This would result in second hanger end 40 being visible on the front of the container 10 on panel 22. Such an orientation has the advantage of utilizing the hanger member 36 as a cover 34 for the absorbent paper material 12 if desired as shown in FIG. 6. The hanger member 36 could cover all or a portion of the first opening 30 prior to releasing the hanger member 36 from the container 10 and dispensing the absorbent paper material 12. Another advantage is the ease of attaching second hanger end 40 to the container 10 when the attachment point is on the front of the container 10.

The container 10 preferably contains an interfolded stack of paper towels, although other products may be packaged in the container. A product comprising container 10 arid interfolded paper towels has the advantage of two dispensing modes. While being utilized in the hanging mode, the container 10 has the advantage of eliminating any counter space requirements, and protecting the absorbent paper material 12 from damage due to liquids on the counter surface. While being utilized on a counter surface, the space provided by the second compartment 60, and any soiled absorbent paper material in the second compartment 60, protects the unused absorbent paper material 12 from any liquids on the counter surface.

Accordingly, while the invention has been described herein in detail in relation to specific embodiments, it is to be understood that this disclosure is only illustrative and exemplary of the invention, and is made merely for purposes of providing a full and enabling disclosure of the invention. The foregoing disclosure is not intended to be construed to limit the invention, or otherwise to exclude any other embodiments, adaptations, variations, modifications and equivalent arrangements; the invention being limited only by the claims appended hereto and the equivalents thereof.

We claim:

1. A packaged product comprising:

a substantially enclosed container containing an absorbent paper material;

said container comprising a first end, a second end, and a sidewall forming an interior surface defining the container, a first opening into the container adapted to dispensing the absorbent paper material, and a hanger member having a first hanger end and a second hanger end, said first hanger end integral with the container; and said second hanger end attached to the container by a first attachment member comprising a plurality of lines of perforation and a removable strip; and the absorbent paper material substantially in contact with the interior surface.

2. The packaged product of claim 1 wherein the absorbent paper material is not contained within a carton placed into the container.

3. The packaged product of claim 1 wherein the container is disposable upon depletion of the absorbent paper material.

4. The packaged product of claim 1 wherein the container fully encloses the absorbent paper material except for the opening.

5. The packaged product of claim 1 wherein the sidewall comprises four panels and the container is generally rectangular.

6. The packaged product of claim 1 wherein at least a portion of the absorbent paper material exposed by the first opening is covered by at least one cover.

7. The packaged product of claim 6 wherein the cover comprises a poly film window with a slit.

8. The packaged product of claim 6 wherein the cover comprises a removable cover attached to the container by lines of perforation.

9. The packaged product of claim 1 wherein the second hanger end is connected to the container by a second attachment member.

10. The packaged product of claim 9 wherein the second hanger end can be attached to the container in at least two positions.

11. The packaged product of claim 9 wherein the hanger member has a first and a second opposing side, and the second hanger end is attached to the container by the second attachment member such that a portion of the first opposing side is adjacent the container and a portion of the first opposing side is adjacent a support member.

12. The packaged product of claim 9 wherein the second attachment member comprises an adhesive.

13. The packaged product of claim 1 wherein the container further comprises a partition attached to the interior surface defining a first compartment and a second compartment, the first compartment containing the absorbent paper material and having the first opening, and the second compartment having a second opening and adapted for use as a waste receptacle.

14. The packaged product of claim 1 wherein the hanger member is integral with the container on both ends.

15. The packaged product of claim 1 wherein the hanger member has a first opposing side and a second opposing side, and the second hanger end is attached to the container by the first attachment member such that the first opposing side is substantially adjacent the container.

16. The packaged product of claim 15 wherein the hanger member covers at least a portion of the first opening.

17. A method of dispensing an absorbent paper material in a container comprising the acts of:

providing a container with a hanger member having a first hanger end and a second hanger end, the first hanger end integral with the container and the second hanger end attached to the container by a first attachment member having a strip and a plurality of lines of perforation;

releasing the second hanger end of the hanger member by removing the strip;

wrapping the second hanger end of the hanger member around a support member;

reattaching the second hanger end of the hanger member to the container with a second attachment member; and withdrawing the absorbent paper material through an opening in the container.

18. The method of claim 17 wherein the act of reattaching the hanger member to the container by the second attachment member comprises an adhesive.

19. A packaged product comprising:

a substantially enclosed container containing an absorbent paper material;

said container comprising a first end, a second end, and a sidewall forming an interior surface defining the container; a first opening into the container adapted to dispensing the absorbent paper material; and a hanger member having a first hanger end, a second hanger end, and a first opposing side;

said first hanger end integral with the container, and said second hanger end attached to the container by a first attachment member wherein the first opposing side covers at least a portion of the first opening; and the absorbent paper material substantially in contact with the interior surface.

20. The packaged product of claim 19 wherein the first attachment member comprises a line of perforations.

21. The packaged product of claim 19 wherein the first attachment member comprises a strip and a plurality of lines of perforation.

22. The packaged product of claim 19 wherein the second hanger end is attached to the container, after releasing the first attachment member, by a second attachment member.

23. The packaged product of claim 22 wherein the second attachment member comprises an adhesive.

24. The packaged product of claim 19 wherein the sidewall comprises four panels, two of the panels being rectangular in shape and two of the panels being trapezoidal in shape.

25. The packaged product of claim 24 wherein a portion of the opening is located in the sidewall, and a portion of the opening is located in one of the first or the second ends.

26. A method of dispensing an absorbent paper material in a container comprising the acts of:

providing a container having an opening adapted to dispensing the absorbent paper material and a hanger member having a first hanger end, a second hanger end, and a first opposing side; the first hanger end integral with the container, the first opposing side covering at least a portion of the opening, and the second hanger end attached to the container by a first attachment member;

releasing the second hanger end from the container to expose the opening; and withdrawing the absorbent paper material through the opening in the container.

27. The method of claim 25 further comprising the acts of:

wrapping the second hanger end around a support member; and reattaching the second hanger end to the container by a second attachment member.

* * * * *